US005953926A

United States Patent [19]

Dressler et al.

[11] Patent Number: 5,953,926

[45] Date of Patent: Sep. 21, 1999

[54] HEATING, COOLING, AND DEHUMIDIFYING SYSTEM WITH ENERGY RECOVERY

[75] Inventors: William E. Dressler, Olathe, Kans.; Lane D. Brown, Angola; Robert G. Walker, Fort Wayne, both of Ind.; Michael J. Housh, Middletown, Ohio

[73] Assignee: Tennessee Valley Authority

[21] Appl. No.: 08/906,771

[22] Filed: Aug. 5, 1997

[51] Int. Cl.[6] ..... F25B 7/00

[52] U.S. Cl. ..... 62/175; 62/160; 62/173; 62/280; 236/44 C

[58] Field of Search ..... 62/175, 90, 280, 62/160, 93, 95, 173; 236/44 R, 44 A, 44 C; 165/222, 223

[56] References Cited

U.S. PATENT DOCUMENTS

| | | | |
|---|---|---|---|
| 2,320,436 | 6/1943 | Hull | 62/280 X |
| 3,456,718 | 7/1969 | de Fries . | |
| 3,623,549 | 11/1971 | Smith, Jr. . | |
| 3,698,472 | 10/1972 | Gold et al. . | |
| 3,788,388 | 1/1974 | Barkmann . | |
| 3,926,249 | 12/1975 | Glancy . | |
| 3,968,833 | 7/1976 | Strindehag et al. . | |
| 3,991,819 | 11/1976 | Clark . | |
| 4,048,811 | 9/1977 | Ito et al. . | |
| 4,061,186 | 12/1977 | Jung . | |
| 4,071,080 | 1/1978 | Bridgers . | |
| 4,142,575 | 3/1979 | Glancy . | |
| 4,157,649 | 6/1979 | Bussjager et al. | 62/160 X |
| 4,175,403 | 11/1979 | Lunde . | |
| 4,295,342 | 10/1981 | Parro . | |
| 4,332,137 | 6/1982 | Hayes . | |
| 4,510,762 | 4/1985 | Richarts . | |
| 4,513,809 | 4/1985 | Schneider et al. . | |
| 4,742,957 | 5/1988 | Mentuch . | |
| 4,887,438 | 12/1989 | Meckler . | |
| 4,896,716 | 1/1990 | Sotani et al. . | |
| 4,952,283 | 8/1990 | Besik . | |
| 5,000,253 | 3/1991 | Komarnicki . | |
| 5,003,961 | 4/1991 | Besik . | |
| 5,179,998 | 1/1993 | Des Champs . | |
| 5,183,098 | 2/1993 | Chagnot . | |
| 5,325,676 | 7/1994 | Meckler . | |
| 5,337,574 | 8/1994 | Dick . | |
| 5,348,077 | 9/1994 | Hillman . | |
| 5,423,187 | 6/1995 | Fournier . | |
| 5,461,876 | 10/1995 | Dressler . | |
| 5,471,852 | 12/1995 | Meckler . | |
| 5,548,970 | 8/1996 | Cunningham, Jr. et al. . | |
| 5,573,058 | 11/1996 | Rolin . | |
| 5,579,647 | 12/1996 | Calton et al. . | |

*Primary Examiner*—Harry B. Tanner
*Attorney, Agent, or Firm*—Donald R. Schoonover

[57] ABSTRACT

An improved heating and cooling system is provided which also includes dehumidification and energy recovery capability. The system includes two or more heat pump circuits operating singly or in concert to provide heating, singly or in concert in reverse to provide cooling, or concurrently but oppositely to provide dehumidification only, dehumidification concurrently with heating, or dehumidification concurrently with cooling. The system is adapted to include desuperheaters while being simultaneously providing heating, cooling, or dehumidification.

38 Claims, 2 Drawing Sheets

HEATING, COOLING, AND DEHUMIDIFYING SYSTEM WITH ENERGY RECOVERY

BACKGROUND OF THE INVENTION

1. Field of the Invention

The present invention relates to a system for heating, cooling and/or dehumidification, singly or in combination, of an environmental load, or heating or cooling a process load, by removing thermal energy from a first media and transferring that thermal energy to a second media for dissipation therein, wherein heat recovery may also be provided.

2. Description of the Related Art

In recent years, society has become ever more concerned about two major environmental conditioning issues. One of those issues involves the improvement of indoor air quality within certain facilities, such as residences, schools, hospitals, office buildings, retail stores, industrial facilities, and the like. The other one of those major issues involves the necessity of reducing the cost of energy required to provide environmental conditioning for such facilities. Since the early 1970's, considerable research has been expended on those two issues which has resulted in significant developments in new engineering standards for the design of systems to meet such needs.

Unfortunately, there exists an inherent problem when attempting to address both of these issues within any particular application. This problem results from the fact that the single most important factor in improving indoor air quality is the introduction of large amounts of outdoor air to refresh the otherwise enclosed space. In light of the fact that outdoor air is itself preferably conditioned before being supplied into the indoor space (i.e., heated, cooled and/or dehumidified), prior art processes typically result in significantly increasing operating costs for any particular facility. Therefore, it should be apparent that these two goals—refreshing with a sufficient quantity of outside air, and conditioning that outside air without significantly increasing operating costs—tend to be mutually limiting.

As noted, substantial research and development has gone into addressing these issues throughout the preceding decades. This collective work has resulted in the investigation of various approaches which can be generally categorized in two basic types: recuperative heat exchange processes, and regenerative heat exchange processes.

In recuperative heat exchange processes, two flowing heat exchange media are separated by a heat transfer surface. Heat is transferred from the media of the higher temperature via thermal conductance through the heat transfer surface into the lower temperature media. For example, apparatuses utilizing a recuperative heat exchange process include tube-in-shell, fin-tube and tube-in-tube heat exchangers.

In regenerative heat exchange processes, a heat exchange material is alternatively heated in a higher-temperature heat exchange media and then physically displaced to a lower-temperature heat exchange media where the material is cooled and the heat transferred away by the surrounding media. For example, apparatuses utilizing a regenerative heat exchange process include systems having rotating or tracking heat exchangers. Examples of prior art developments utilizing each of the types of such processes are hereinafter described.

A system having a regenerative heat exchange design was disclosed in U.S. Pat. No. 3,456,718 by Jan R. de Fries, issued Jul. 22, 1969. That system incorporates a special disc-shaped heat exchanger that rotates within a blower unit between two separate air streams. The heat exchanger is heated by the hotter of the two air streams and rotated into the cooler of the two air streams where the heat is released. Such a system is effective for transferring heat, but has the distinct disadvantage of constantly intermixing the two air streams and of being limited to only preheating or precooling of the conditioned air. In other words, the de Fries system is ineffective in providing dehumidification. As a result, practical applications of the system have generally required integration of desiccant wheels into the designs to provide dehumidification of the air being conditioned. Such desiccant wheels function by absorbing unwanted moisture from the conditioned air and, as the wheel is rotated into a very hot air system, by releasing that absorbed moisture through the process of evaporation thereby drying the desiccant material in preparation for the next cycle.

Prior art systems that incorporate desiccants within fresh air make-up provisions in a regenerative heat exchange apparatus include U.S. Pat. No. 4,513,809 issued Apr. 30, 1985 to Steven L. Schneider et al, which discloses both a rotating desiccant wheel and a rotating heat exchanger matrix; U.S. Pat. No. 5,548,970 issued Aug. 27, 1996 to Robert A. Cunningham, Jr., et al, which discloses a rotating desiccant wheel in a refrigeration system to improve air conditioning of supply air but which makes no provision for recovering energy from the exhaust air; U.S. Pat. No. 4,887,438 issued Dec. 19, 1989 to Milton Meckler, which discloses a system for only cooling and dehumidification wherein a desiccant wheel is used with a refrigerant-type air conditioning system and wherein heat from cooling the supply air is transferred to the exhaust air to regenerate the desiccant; and U.S. Pat. No. 5,003,961 issued Apr. 2, 1991 to Ferdinand K. Besik, which discloses the use of a solid, non-movable desiccant and heat exchange matrices through which air flows of exhaust air and then supply air are alternately counter flowed, with final heating being provided by a combustion heater and cooling being provided by a refrigerant-type air conditioner. Systems based on desiccant exchangers are generally expensive to produce and operate and offer only a limited service life before the heat exchange and/or the desiccant media must be replaced. Such designs have primarily been used on small scale applications.

Another regenerative heat exchange system is disclosed in U.S. Pat. No. 3,698,472 issued Oct. 17, 1972 to Harold E. Gold et al, wherein a continuous blanket-type heat exchange media is continuously tracked therethrough with basically the same advantages and disadvantages as previous disk-type systems. Because of the complexity of operation and a high maintenance factor associated with this design, minimal demand has been realized in the marketplace.

Prior art recuperative heat exchange systems that incorporate desiccants within fresh air make-up provisions include U.S. Pat. No. 3,623,549 issued Nov. 30, 1971 to Horace L. Smith, Jr., which utilizes multiple, independent heat exchangers for transferring heat in one direction only, namely from a very high temperature source of air (i.e., 500° F.) to a very low temperature source of air (i.e., 32° F.). Each of the multiple units consisted of two liquid-to-air heat exchangers connected by piping, a liquid pump and a flow control valve, sometimes referred to in the industry as "run-around coils". Single run-around coils have been used for decades in applications for transferring moderate heat between fresh air and exhaust air supplies. However, the Smith application required transferring heat between a very high temperature and a very low temperature for which a single heat transfer fluid could not be used without either boiling-off or freezing-up. By staging the run-around coils, the Smith approach was able to use heat transfer fluids having different boiling and freezing properties which permitted dividing the difference between the two extreme temperatures into acceptable ranges of operation. Although such a design is effective for pre-heating fresh air, it is significantly less efficient in pre-cooling the fresh air and ineffective in removing humidity. As a result, the Smith multi-coil design is generally only applicable to certain highly specialized industrial applications.

Another recuperative design was disclosed in U.S. Pat. No. 3,968,833 issued Jul. 13, 1976 to Ove Strindehag et al, which incorporates a run-around coil design that integrates a secondary liquid-to-air and liquid-to-liquid heat exchange loop to help prevent freeze-up and to boost the temperature of the supply air stream. Heat is supplied to the secondary heat exchange loop by an external source, such as a boiler. Unfortunately, this design has all the disadvantages of other run-around coil designs with regard to cooling and dehumidification.

Another recuperative run-around coil design was disclosed in Patent U.S. Pat. No. 4,061,186 issued Dec. 6, 1977 to Ake Ljung, wherein a unique liquid-to-liquid refrigeration system is incorporated into a complex run-around coil design in order to boost the operating temperatures of the system and enable it to provide a certain level of cooling and dehumidification. Although this approach expands the operating parameters of this type of run-around coil design, the disadvantages include high initial costs, less than optimum efficiency, and expensive and time demanding maintenance of both of the complex liquid and refrigerant systems. A similar system is disclosed in U.S. Pat. No. 4,510,762 issued Apr. 16, 1985 to Fritz Richarts, wherein a combustion engine is utilized to drive a heat pump with waste heat from the combustion engine being used to provide additional heating for the supply air.

Another run-around coil system was disclosed in U.S. Pat. No. 4,142,575 issued Mar. 6, 1979 to Walter P. Glancy, wherein a complete, packaged system for providing fresh air make-up with exhaust air capabilities, sometimes referred to in the industry as a "make-up air unit". A simple, liquid run-around coil is used to precondition the fresh air supply. An earlier patent granted to Walter P. Glancy, namely U.S. Pat. No. 3,926,249 issued Dec. 16, 1975 disclosed another simplistic ventilation system that employs a run-around coil design which, unfortunately, has all the limitations of his earlier run-around coil systems but which did provide an inexpensive heat recovery option with a reasonable economic benefit.

Another design disclosed in U.S. Pat. No. 4,332,137 issued Jun. 1, 1982 to Richard S. Hayes, Jr. utilizes two independently controllable heat pumps, one for heating and the other for cooling. The Hayes, Jr. system, however, does not provide fresh air makeup and does not provide heat recovery.

U.S. Pat. No. 4,742,957 issued May 10, 1988 to Stephen Mentuch utilizes a heat pipe-type of heat exchanger in a fresh air make-up system, a system which would have operating characteristics comparable to those of a run-around coil system. Although the heat pipe design simplifies both production and operation of the system and reduces maintenance requirements thereof, this system has the disadvantage of not being very effective for dehumidification purposes.

An alternative to the heat pipe pre-conditioner design for ventilation purposes may utilize an expanded plate-type heat exchanger wherein the expanded plate heat exchanger comprises a series of thin metal plates that are configured to form numerous independent flow passages for each air stream. The result is efficient conductive heat transfer between the air streams. A example of such a heat exchanger is disclosed in U.S. Pat. No. 5,000,253 issued Mar. 19, 1991 to Roy Komarnicki.

Another concept was disclosed in U.S. Pat. No. 5,179,998 issued Jan. 19, 1993 to Nicholas H. Des Champs, wherein two efficient expanded plate heat exchangers and a conventional refrigeration unit are used to provide a fresh air make-up system for a swimming pool enclosure. A standard air source refrigerant coil is integrated into the system to control the level of humidity. If necessary, an optional heater is provided to heat condition the make-up fresh air after passing through both plate heat exchangers and the refrigerant coil. This system is typically quite expensive, especially when applied to a corrosive pool environment. Further, the bulkiness of the plate heat exchangers largely restricts the use of this system to large scale applications.

Relatively recently, some prior art designs have attempted to combine both recuperative and regenerative technologies into a single complex system. An example thereof is disclosed in U.S. Pat. No. 5,579,647 issued Dec. 3, 1996 to Dean S. Calton et al, which system provides only central air conditioning and dehumidification but which, with minor modification, could function as a make-up air system. This design combines a rotating desiccant wheel, a rotating heat exchanger, and a single-refrigerant air conditioning circuit with multiple condensers and evaporators. The heat rejected from the air conditioning condenser coils is used to rejuvenate the desiccant dehumidifier wheel. Though this system does provide cooling and dehumidification, albeit at high initial cost and operating expense, it does not provide heating. Similar designs were disclosed in U.S. Pat. No. 5,325,676 issued Jul. 5, 1994 to Milton Meckler which incorporates a heat pipe exchanger in lieu of the rotating heat exchange wheel, and U.S. Pat. No. 5,471,852 issued Dec. 5, 1995 to Milton Meckler that utilizes a liquid desiccant, a heat pipe exchanger, and a refrigerant air conditioner with a desuperheater for rejuvenating the desiccant liquid.

Conventional reverse cycle heat pump technology has become a standard method of providing heating and cooling to building environmental spaces as well as process loads in industrial processes. These systems have proven to be relatively effective and efficient throughout a broad climatic region of the United States. The acceptance of heat pump systems over the past three to four decades testifies to the growing success of this technology. Heat pump systems have also made inroads into the make-up air technology as well.

As for heat recovery, an example of such a feature in a basic heat pump circuit is disclosed in U.S. Pat. No. 5,348,077 issued Sep. 20, 1994 to Chris F. Hillman.

Still, such prior art systems have not provided cooling, heating, dehumidification, and heat recovery in a single system with the desired capabilities, efficiencies, and control. What is needed is a single system that does provide the desired capabilities, efficiencies, and control.

SUMMARY OF THE INVENTION

An improved system is provided for heating, cooling and dehumidifying purposes with heat recovery.

According to the present invention, there is provided a system for conditioning a first media by utilizing a second media, the system comprising a first heat pump circuit having a first transient load heat exchanger structured to selectively absorb thermal energy from and discharge thermal energy to the first media, and a second transient load heat exchanger structured to selectively absorb thermal energy from and discharge thermal energy to the second media, wherein the first transient load heat exchanger is structured to absorb thermal energy from the first media and transfer thermal energy to the second transient load heat exchanger as the first heat pump circuit operates in a first circuit cooling mode and the second transient load heat exchanger is structured to absorb thermal energy from the second media and transfer thermal energy to the first transient load heat exchanger as the first heat pump circuit operates in a first circuit heating mode; a second heat pump circuit having a third transient load heat exchanger structured to selectively absorb thermal energy from and discharge thermal energy to the first media, and a fourth transient load heat exchanger structured to selectively absorb thermal energy from and discharge thermal energy to the second media; wherein the third transient load heat exchanger is structured to absorb thermal energy from the first media and transfer thermal energy to the fourth transient load heat exchanger as the second heat pump circuit operates in a second circuit cooling mode and the fourth transient load heat exchanger is structured to absorb thermal energy from the second media and transfer thermal energy to the third transient load heat exchanger as the second heat pump circuit operates in a second circuit heating mode; and a control mechanism structured to automatically and selectively control the first heat pump circuit in either of the first circuit heating and cooling modes and to selectively operate the second heat pump circuit in either of the second circuit heating and cooling modes. The third and fourth transient load heat exchangers may comprise a single combination heat exchanger having independent refrigerant flow passages.

The system may include a dehumidification mechanism, which may be automatically and selectively controlled by the control mechanism, wherein the first heat pump circuit is simultaneously operated in the first circuit cooling mode as the second heat pump circuit is operated in the second circuit heating mode. Alternatively, the control mechanism may also be structured to automatically and selectively control the dehumidifying mechanism wherein the first heat pump circuit is simultaneously operated in the first circuit heating mode as the second heat pump circuit is operated in the second circuit cooling mode.

The dehumidifying mechanism may include a condensate dissipation mechanism, wherein the condensate dissipation mechanism includes one or both of the first and third transient load heat exchangers having a drip pan; a dissipater positioned in the second media; and a pump and conduit arrangement interconnecting the drip pan and the dissipater. Further, the dehumidifying mechanism may include a dehumidification device structured to absorb moisture from the first media and release that moisture to the second media, such as a rotating desiccant wheel device for example.

The system may also include an energy recovery mechanism structured to transfer energy to and from the first and second media. The control mechanism may be structured to automatically and selectively control the energy recovery mechanism. The energy recovery mechanism may include a first auxiliary heat exchanger in thermal transfer communication with the first media, and a second auxiliary heat exchanger in thermal transfer communication with the second media, wherein the first and second auxiliary heat exchangers are interconnected such that thermal energy is automatically transferred from the hotter of the first and second media to the cooler of the second and first media. The first and second auxiliary heat exchangers may comprise conductive heat exchangers, run-around liquid heat exchangers, expanded plate heat exchangers, heat pipe exchangers, or other suitable heat exchangers.

The system may include one or more desuperheaters connected to one or both of the first and second heat pump circuits. Further, the system may include a valve mechanism adapted to selectively bypass a respective one of the desuperheaters.

Also, one or both of the first and second heat pump circuits may include a metering mechanism which may also include a refrigerant bypass mechanism adapted to selectively bypass a respective one of the metering mechanisms, wherein each refrigerant bypass mechanism includes a pressure regulator and a check valve connected in bypass arrangement about the respective metering mechanism.

Further, one or both of the first and second heat pump circuits may include a pressure regulating valve situated downstream from the respective first and/or third transient load heat exchangers.

Also, one or both of the first and second heat pump circuits may include a refrigerant compression device wherein the control mechanism may include one or more refrigerant pressure mechanisms structured to control the refrigerant pressure provided by the refrigerant compression device in a respective one of the first and second heat pump circuits, such as a hot gas bypass valve.

One or both of the first and second heat pump circuits may also include a refrigerant storage device structured to separate and store excess liquid refrigerant therein. Further, the control mechanism may include a first reversing valve for converting the first heat pump circuit to and from the first circuit heating mode and the first circuit cooling mode, and a second reversing valve for converting the second heat pump circuit to and from the second circuit heating mode and the second circuit cooling mode.

According to the present invention, there is further provided a heating, cooling, and dehumidifying system, comprising two or more heat pump circuits, each of which is connected in thermal transfer communication between two different respective media and includes structure to provide a circuit heating mode wherein thermal energy is transferred from a first one to the second one of the two different respective media; and includes structure to provide a circuit cooling mode wherein thermal energy is transferred from the second one to the first one of the two different respective media; and wherein the system includes structure to provide a combination heating mode wherein one or more of the two or more heat pump circuits is connected in thermal transfer communication with the same media and operated in a respective circuit heating mode relative to the same media, structure to provide a combination cooling mode wherein one or more of the two or more heat pump circuits is connected in thermal transfer communication with the same media and operated in its respective circuit cooling mode relative to the same media, and structure to provide a dehumidifying mode wherein two or more of the heat pump circuits are connected in thermal transfer communication with the same media, at least one of the two heat pump circuits being operable in a respective circuit heating mode and another one of the two or more heat pump circuits being operable in its respective circuit cooling mode relative to the same media.

According to the present invention, there is still further provided a system for dehumidifying a gaseous media by utilizing a second media, comprising a first heat pump circuit having a first transient load heat exchanger connected in thermal transfer communication with the gaseous media, and a second transient load heat exchanger connected in thermal transfer communication with the second media, wherein the first transient load heat exchanger is structured to absorb thermal energy from the gaseous media and transfer thermal energy to the second transient load heat exchanger; and a second heat pump circuit having a third transient load heat exchanger connected in thermal transfer communication with the gaseous media, and a fourth transient load heat exchanger connected in thermal transfer communication with the second media; wherein the third transient load heat exchanger is structured to absorb thermal energy from the second media and transfer thermal energy to the fourth transient load heat exchanger.

As the system assumes the dehumidifying mode wherein two heat pump circuits are in thermal transfer communication with the same media and wherein a first one of those heat pump circuits is operated in a circuit heating mode and the second one of those heat pump circuits is operated in a circuit cooling mode relative to the same media, the first heat pump circuit may be operated relative to the second heat pump circuit at a rate wherein thermal energy is transferred to the same media, transferred away from the same media, or neither, depending on whether dehumidification of the same media is being provided concurrently with a net heating effect, a net cooling effect, or dehumidification only with neither heating or cooling, respectively.

PRINCIPAL OBJECTS AND ADVANTAGES OF THE INVENTION

The principal objects and advantages of the present invention include: providing a process and apparatus having at least two independently controllable heat pump circuits for selectively heating and cooling various media; providing such a process and apparatus having dehumidification capability; providing such a process and apparatus having provisions for energy recovery; providing such a process and apparatus having supplemental heat exchanging arrangements; providing such a process and apparatus having supplemental dehumidification devices; providing such a process and apparatus having at least one desuperheater; and generally providing such a method and apparatus that are reliable in performance, efficient in operation, provide long life usage, and are particularly well adapted for the proposed usages thereof.

Other objects and advantages of this invention will become apparent from the following description taken in conjunction with the accompanying drawings wherein are set forth, by way of illustration and example, certain embodiments of this invention.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
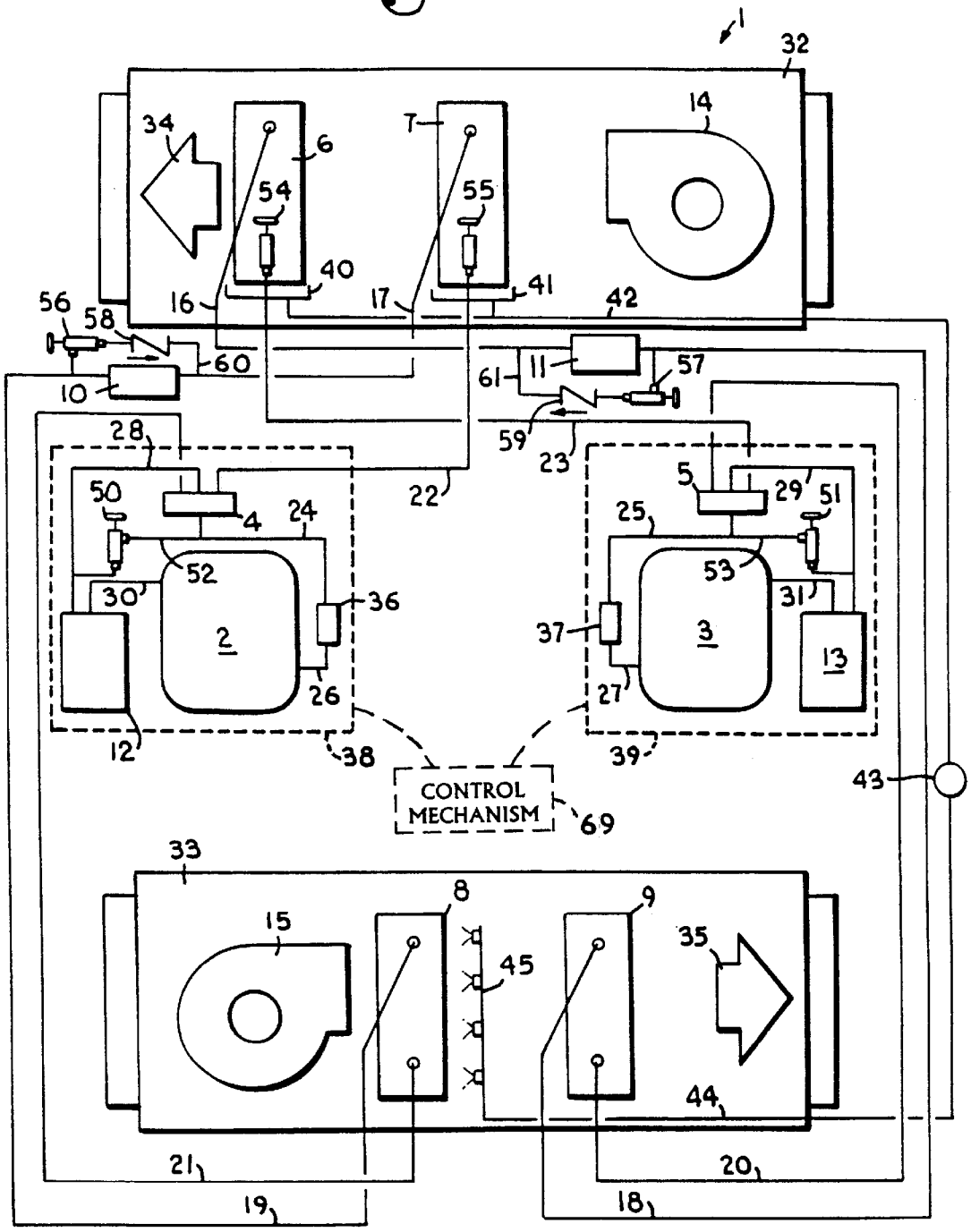
FIG. 1 is schematic representation of a heating, cooling and dehumidifying system with energy recovery, according to the present invention.
Figure 2:
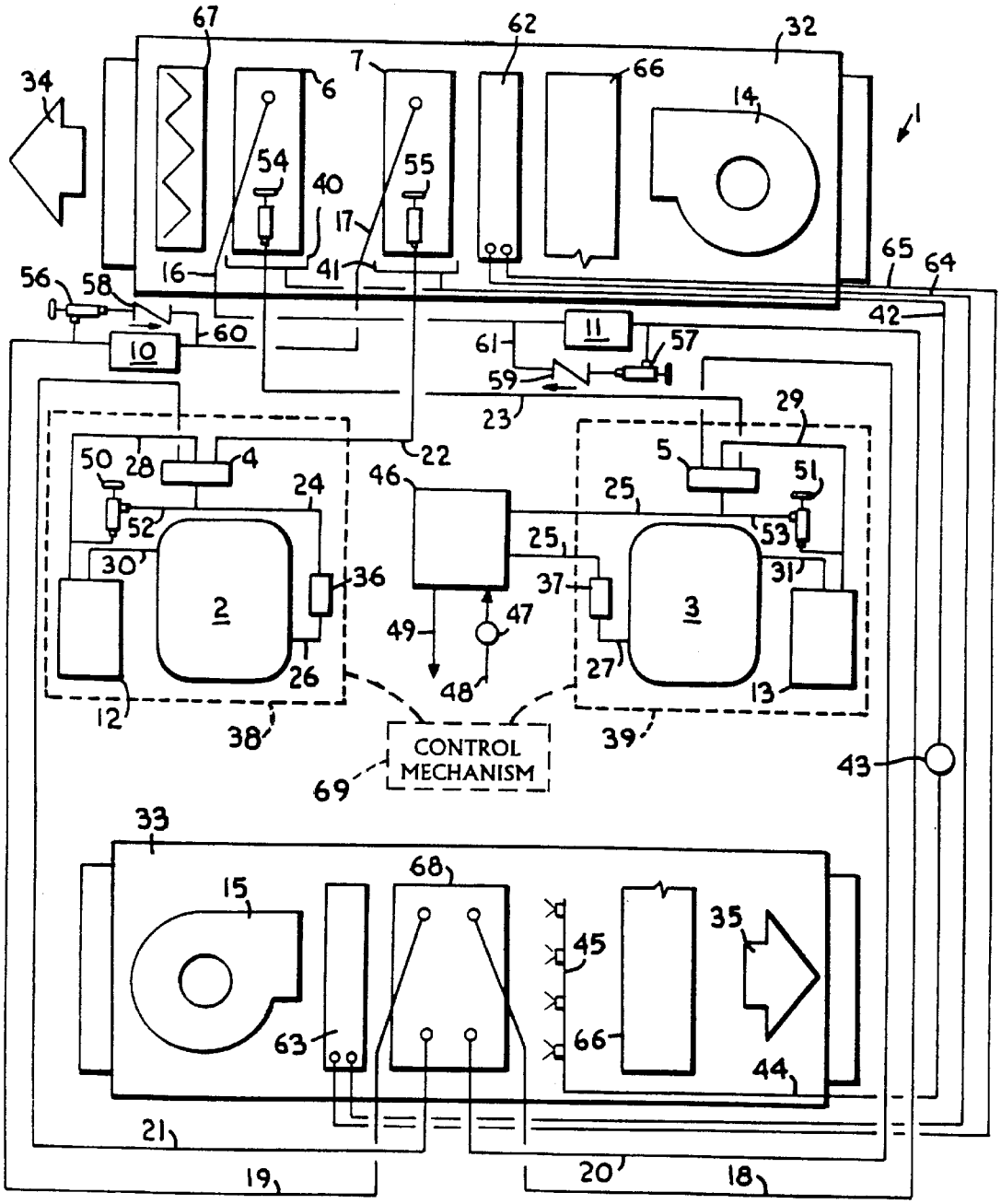
FIG. 2 is also a schematic representation of the heating, cooling and dehumidifying system with energy recovery, according to the present invention.

The reference numeral 1 generally refers to a heating, cooling and dehumidifying system having energy recovery capability in accordance with the present invention, as shown in FIGS. 1 and 2. The heating, cooling and dehumidifying system 1 generally comprises multiple refrigerant compression devices such as compressors 2 and 3, valving means such as reversing or four-way valve assemblies 4 and 5, energy transfer devices such as transient or dynamic load heat exchangers 6, 7, 8 and 9, refrigerant metering devices having active flow controls or metering mechanisms such as expansion valves 10 and 11, refrigerant storage devices such as accumulators or active charge controls 12 and 13, load mass transfer devices 14 and 15, and distribution means such as refrigerant transfer conduits 16 through 31, as shown in FIG. 1.

The system 1 contains refrigerant, such as HCFC R-22 Freon as provided by Dow Chemical Company or other suitable refrigerant. The system 1 also contains compressor lubricant such as refined mineral oil or other suitable lubricant. In an exemplary application, the transient or dynamic load heat exchangers 6 and 7 may be packaged with the load mass transfer device 14 in an energy transfer unit 32 to facilitate the transpirational transfer of a transient energy load 34 such as may be induced by fresh outdoor air being supplied to a building environment, sometimes referred to as a "make-up air handler", or an industrial process. Similarly, the transient or dynamic load heat exchangers 8 and 9 may also be packaged with the load mass transfer device 15 in an energy transfer unit 33 to facilitate the transpirational transfer of a second energy load 35, different from the first transient load 34, such as may be induced by the exhaust air from a building environment, sometimes referred to as an "exhaust air handler", or an industrial process.

Certain of the conduits that normally convey liquid-phase refrigerant, sometimes referred to herein as "liquid lines", such as the conduits 16 through 19, generally have a smaller inside diameter than those of the conduits that normally convey gaseous-phase refrigerant, sometimes referred to herein as "vapor lines", such as the conduits 20 through 31. For example, heat pump subsystems comprising various components may have a nominally rated heat transfer capacity of five tons (60,000 BTU/hr.) with liquid lines and vapor lines having one-half inch and one-inch inside diameters, respectively. Preferably, actual system capacity and liquid- and vapor-line sizing is determined in accordance with appropriate industry standards, such as those set forth by the American Society of Heating, Refrigerating and Air-conditioning Engineers or similar organization, or regulatory agency.

Heating Mode of Operation

In an application wherein it is desirable to add heat to the first transient load 34 of the system 1, sometimes referred to herein as the "heating mode", the compressor 2 discharges a substantially gaseous refrigerant having a relatively high temperature generally in the range of approximately 90° F. to 150° F. and a relatively high pressure generally in the range of approximately 120 to 225 pound per square inch ("psi"), into the hollow conduit 26. The conduit 26 may comprise common refrigerant tubing or the like constructed of copper or other suitable material. That gaseous refrigerant then passes through an optional muffler 36, which assists in reducing the operating noise of the system 1, and into the conduit 24.

The refrigerant is then directed by the reversing valve 4 through the conduit 22 into the dynamic load heat exchanger 7. There, heat contained in the refrigerant is transferred by the heat exchanger 7 to the media of the transient load 34, thereby cooling the refrigerant and heating the transient load 34. As a result, the refrigerant is substantially converted to a liquid phase, generally having a temperature in the range of approximately 50° F. to 100° F. with a relatively high pressure generally in the range of approximately 80 psi to 180 psi. The refrigerant is then transported by the conduit 17 to the metering device 10.

The metering device 10 is configured, in addition to appropriately regulating the flow of the refrigerant to cooperatively optimize the heating performance of the system 1, to provide a pressure differential between the liquid refrigerant in the conduit 17 upstream from the metering device 10 and the liquid refrigerant in the conduit 19 downstream from the metering device 10. The refrigerant downstream from the metering device 10 exhibits a relatively low temperature generally in the range of approximately 30° F. to 60° F. and a relatively low pressure generally in the range of approximately 60 psi to 90 psi.

This cooled refrigerant, which is conducted by the conduit 19 to the transient load heat exchanger 8 for interaction with the second transient load 35, which serves as a thermal mass heat source whereat the refrigerant cools the media of the transient load 35 by absorbing heat therefrom. The refrigerant, after absorbing heat from the transient load 35, exits into the conduit 21 substantially in a gaseous phase with a relatively low temperature generally in the range of approximately 40° F. to 70° F. and a relatively low pressure generally in the range of approximately 30 psi to 70 psi.

Upon exiting from the conduit 21, the refrigerant is diverted by the reversing valve 4 into the conduit 28 and to and through the refrigerant storage device 12, which separates and stores any excess liquid refrigerant returned thereto. The remaining gaseous refrigerant is directed from the refrigerant storage device 12 by the conduit 30 to a suction intake of the compressor device 2, completing the heating cycle that is repeated as long as the transient load 34 requires heating. The collective components hereinbefore described may sometimes be referred to herein as a first heat pump circuit, symbolically illustrated by the dashed box designated by the numeral 38.

Operation of a heat pump circuit, such as the first heat pump circuit 38, in the heating mode may sometimes be referred to herein as a circuit heating mode. Also, operation of two heat pump circuits in concert, with each operating in a circuit heating mode, may sometimes be referred to herein as a combination heating mode.

During the aforedescribed heating mode of operation, other components of the system 1 may be utilized to assist the first heat pump circuit 38 in providing heat transfer from the transient load 35 to the transient load 34, if desired. In that event, the compressor 3 discharges substantially gaseous refrigerant, having a relatively high temperature generally in the range of approximately 120° F. to 160° F. and a relatively high pressure generally in the range of approximately 150 psi to 225 psi, into the conduit 27, through an optional muffler 37, and into the conduit 25. The refrigerant is then directed by the reversing valve 5 through the conduit 23 into the transient or dynamic load heat exchanger 6. Heat is then transferred by the heat exchanger 6 into the first transient load 34, further increasing the temperature of the media of the transient load 34. As a result, the refrigerant, which is then cooled such that it substantially exists in a liquid phase having a temperature generally in the range of approximately 80° F. to 120° F. and a relatively high pressure generally in the range of approximately 120 psi to 180 psi, is transported by the conduit 16 to the metering device 11. As before, the metering device 11 causes a pressure differential to be generated between the liquid refrigerant in the conduit 16 and the liquid refrigerant in the conduit 18 and, further, permits regulation of the flow of refrigerant in order to permit cooperatively obtaining optimum operational performance of the system 1.

The refrigerant exits the metering device 11 in substantially a liquid phase, having a relatively low temperature generally in the range of approximately 30° F. to 60° F. and a relatively low pressure generally in the range of approximately 60 psi to 90 psi. The cooled refrigerant is then directed through the conduit 18 to the transient load heat exchanger 9 where it absorbs heat from the second transient load 35. As a result, the media of the second transient load 35, which again serves as a thermal mass energy source, is further cooled. The refrigerant, after absorbing heat from the media of the second transient load 35, exits into the conduit 20 in substantially a gaseous phase, having a relatively low temperature generally in the range of approximately 40° F. to 70° F. and a relatively low pressure generally in the range of approximately 30 psi to 70 psi. The refrigerant is then diverted into the conduit 29 by the reversing valve 5, which directs the substantially gaseous refrigerant to and through the refrigerant storage device 13 for separation and storage of any excess liquid refrigerant returned thereto. The remaining gaseous refrigerant is then directed by the conduit 31 to a suction intake of the compressor device 3. As before, this cycle is continued until desired heating of the transient load 34 is satisfied.

It should be noted that the upstream exchanger, namely the dynamic load heat exchanger 7 as shown in FIG. 1, is generally exposed to an environment that differs from that of the downstream exchanger, namely the dynamic load heat exchanger 6 as shown in FIG. 1. Such difference results from the upstream or dynamic load heat exchanger 7 being subjected to an unconditioned media whereas the downstream or dynamic load heat exchanger 6 is subjected to a partially conditioned media after exposure of the media to the upstream exchanger. Similar conditions apply to the relative positioning of the dynamic load heat exchangers 8 and 9.

It is to be understood that although the dynamic load heat exchanger 7 is shown upstream from the dynamic load heat exchanger 6, some applications may require that the dynamic load heat exchanger 7 be positioned downstream from the dynamic load heat exchanger 6. Similarly, some applications may require that the upstream/downstream relationship between the dynamic load heat exchangers 8 and 9 be reversed from that shown in FIG. 1. The collective components immediately hereinbefore described in relation to the compressor 3, etc., may sometimes be referred to herein as a second heat pump circuit, symbolically illustrated by the dashed box designated by the numeral 39.

It is also to be understood that, instead of operating the first heat pump circuit 38 and the second heat pump circuit 39 together as described, either of the first heat pump circuit 38 and the second heat pump circuit 39 may be operated alone to provide the desired heating of the first transient load 34.

The cooperative interrelationships of the various components of the first heat pump circuit 38 are selectively controlled by a control mechanism, which control mechanism also selectively controls the cooperative interrelationships of the various components of the second heat pump circuit 39, all by methods known in the art. The control mechanism and such methods associated with each of the first and second heat pump circuits 38 and 39 and components related directly or indirectly thereto are symbolically represented by the dashed box designated by the numeral 69 in FIGS. 1 and 2.

Although the foregoing discussion has more or less centered on two heat pump circuits, namely the first and second heat pump circuits 38 and 39, it is to be understood that some industrial processes may utilize three, four, or more heat pump circuits that operate similarly to that described for the first and second heat pump circuits 38 and 39. In that event, each and all of the various heat pump circuits would be monitored and controlled by the control mechanism 69, similar to that herein described.

Cooling Mode of Operation

In an application wherein it is desirable to remove heat from the first transient load 34 of the system 1, sometimes referred to herein as the "cooling mode", the compressor 2 discharges a substantially gaseous refrigerant, having a relatively high temperature generally in the range of approximately 100° F. to 200° F. and a relatively high pressure generally in the range of approximately 150 psi to 225 psi, into the conduit 26, through the optional muffler 36, and into the conduit 24. The refrigerant is then directed by the reversing valve 4 through the conduit 21 and into the dynamic load heat exchanger 8. Heat contained in the refrigerant is transferred by the heat exchanger 8 into the second transient load 35, which now serves as a heat sink. As a result, the refrigerant is cooled such that it is substantially converted to a liquid phase having a temperature generally in the range of approximately 70° F. to 100° F. and a relatively high pressure generally in the range of approximately 120 psi to 200 psi. The refrigerant is then transported by the conduit 19 to the metering device 10 which, in addition to permitting regulation of the flow of refrigerant for cooperatively obtaining optimum operational cooling of the system 1, causes a pressure differential to be generated between the liquid refrigerant contained in the conduits 19 and 17.

The refrigerant exiting from the metering device 10 exists in a substantially liquid phase, with a relatively low temperature generally in the range of approximately 30° F. to 60° F. and a relatively low pressure generally in the range of approximately 60 psi to 90 psi. This cooled refrigerant is then conducted by the conduit 17 to the transient load heat exchanger 7 where it absorbs heat from the first transient load 34. As a result, the media of the first transient load 34 is cooled and, in some cases, dehumidified. The refrigerant, after absorbing heat from the media of the first transient load 34, exits from the transient load heat exchanger 7 into the conduit 22 in substantially a gaseous phase having a relatively low temperature generally in the range of approximately 40° F. to 60° F. and a relatively low pressure generally in the range of approximately 30 psi to 70 psi.

The refrigerant is then diverted into the conduit 28 by the reversing valve 4 and to and through the refrigerant storage device 12 whereat excess liquid refrigerant is separated and stored, with the remaining gaseous refrigerant returned by the conduit 30 to a suction intake of the compressor device 2. The described cycle is continued until desired cooling of the first transient load 34 is accomplished.

During the aforedescribed cooling mode of operation, the second heat pump circuit 39 may be utilized to assist the first heat pump circuit 38 in providing heat transfer from the transient load 34 to the transient load 35, if desired. In that event, the compressor 3 discharges substantially gaseous refrigerant, having a relatively high temperature generally in the range of approximately 120° F. to 220° F. and a relatively high pressure generally in the range of approximately 175 psi to 275 psi, into the conduit 27, through the optional muffler 37, and into the conduit 25. The refrigerant is then directed by the reversing valve 5 through the conduit 20 into the dynamic load heat exchanger 9. Heat is then transferred by the heat exchanger 9 into the second transient load 35 which, again, serves as a heat sink in the cooling mode of operation. As a result, the refrigerant, which is there cooled such that it substantially exists in a liquid phase having a temperature generally in the range of approximately 80° F. to 120° F. and a relatively high pressure generally in the range of approximately 150 psi to 225 psi, is transported by the conduit 18 to the metering device 11. As before, the metering device 11 causes a pressure differential to be created between the liquid refrigerant contained in the conduit 18 and the liquid refrigerant contained in the conduit 16, and enables regulation of the flow of refrigerant whereby optimum performance of the system 1 may be cooperatively obtained.

The refrigerant exiting the metering device 11 is substantially in a liquid phase, having a relatively low temperature generally in the range of approximately 30° F. to 60° F. and a relatively low pressure generally in the range of approximately 60 psi to 90 psi. The cooled refrigerant is then directed through the conduit 16 to the transient load heat exchanger 6 where it absorbs heat from the first transient load 34. As a result, the first transient load 34 media is further cooled and, in some cases, dehumidified. The refrigerant, after absorbing heat from the media of the first transient load 34, exits into the conduit 23 in substantially a gaseous phase, having a relatively low temperature generally in the range of approximately 40° F. to 70° F. and a relatively low pressure generally in the range of approximately 30 psi to 70 psi. The refrigerant is then diverted into the conduit 29 by the reversing valve 5, which directs the substantially gaseous refrigerant to and through the refrigerant storage device 13 for separation and storage of any excess liquid refrigerant returned thereto. The remaining gaseous refrigerant is then directed by the conduit 31 to a suction intake of the compressor device 3. As before, this cycle is continued until desired cooling of the transient load 34 is accomplished.

Again, it is to be understood that, instead of operating the first heat pump circuit 38 and the second heat pump circuit 39 together as described, either of the first heat pump circuit 38 and the second heat pump circuit 39 may be operated alone to provide the desired cooling of the first transient load 34.

Operation of a heat pump circuit, such as the first heat pump circuit 38, in the cooling mode may sometimes be referred to herein as a circuit cooling mode. Also, operation of two heat pump circuits in concert, with each operating in a circuit cooling mode, may sometimes be referred to herein as a combination cooling mode.

Dehumidification Mode of Operation

In an application wherein it is desirable to remove humidity from the first transient load 34 of the system, sometimes referred to herein as the "dehumidification mode", the first heat pump circuit 38 may be operated similarly to that hereinbefore described for the cooling mode to cause moisture to condense out of the media of the first transient load 34. Simultaneously, the second heat pump circuit 39 would be operated similarly to that hereinbefore described for the heating mode to re-heat the media of the first transient load 34 in order to compensate for the cooling effect of the immediately preceding dehumidification process.

It is to be understood that the amount of re-heating may be substantially similar to the amount of cooling used to accomplish the dehumidification if no conditioning other than dehumidification is desired. In other words, the system 1 would be operating in an essentially "dehumidification only" mode.

Alternatively, the amount of re-heating may be less than the cooling used to accomplish the dehumidification if some cooling conditioning of the media of the transient heat load 34 is desired in addition to the dehumidification; or, the amount of re-heating may be greater than the cooling used to accomplish the dehumidification if some heating conditioning of the media of the transient load 34 is desired in addition to the dehumidification.

In other words, the transient load heat exchanger 7 pre-cools the media to remove undesirable moisture from the transient load 34 followed by conditioning by re-heating the media of the transient load 34 to a desired delivery temperature with the transient load heat exchanger 6, a process sometimes referred to herein as a "low-high" dehumidification mode.

Alternatively, the first heat pump circuit 38 may be operated similarly to that hereinbefore described for the heating mode to preheat the first transient load 34 in order to partially or entirely compensate for the cooling effect of a subsequent dehumidification process. Simultaneously, the second heat pump circuit 39 would be operated similarly to that hereinbefore described for the cooling mode. In other words, the transient load heat exchanger 6 removes undesirable moisture from the media of the transient load 34 while cooling that preheated media to a desired delivery temperature, a process sometimes referred to herein as a "high-low" dehumidification mode.

It is to be understood that the magnitude of cooling provided by one of the first and second transient load heat exchangers 6 and 7 relative to the magnitude of heating provided by the other of the second and first transient load heat exchangers 7 and 6 can be controlled whereby the system 1 provides the desired dehumidification while simultaneously providing the desired heating or cooling of the media of the first transient heat exchanger 34. Similar considerations apply for dehumidification of the media of the second transient load heat exchanger 35, if desired, particularly when used in conjunction with optional auxiliary components hereinafter described.

Whether employing the "low-high" dehumidification mode or the "high-low" dehumidification mode, the result is an efficient and effective dehumidification process which avoids the undesirable and expensive temperature shift of the transient load 34 media associated with prior art techniques.

It should now be obvious to a person having ordinary skill in the art that the first and second heat pump circuits 38 and 39 may be operated: (i) alone, with either one active and the other inactive; (ii) together, to simultaneously provide heat energy to at least one transient media while simultaneously providing cooling for one or more different transient media; or (iii) oppositely, to simultaneously provide sequential cooling and heating, or vice versa, to the same transient media.

Heat Recovery Modifications

If desired, the current invention may include optional supplemental or auxiliary heat exchangers, such as first auxiliary heat exchanger 62 and second auxiliary heat exchanger 63 as shown in FIG. 2, interconnected by conduits 64 and 65 and generally controlled by the control mechanism 69 to improve various efficiencies of the system 1. For example, the auxiliary heat exchangers 62 and 63 may be conductive heat exchangers such as run-around liquid heat exchangers, expanded plate heat exchangers, heat pipe exchangers, or other suitable heat transfer arrangements. Benefits provided by these supplemental heat exchangers 62 and 63 include the simply transfer of thermal energy from the transient load 34 or 35 having a higher temperature to the other transient load 35 or 34 having a lower temperature.

Additionally or alternatively, the system 1 may include an optional dehumidification device 66, as shown in FIG. 2, to further improve the dehumidification efficiency of the system 1. For example, the optional dehumidification device 66 may comprise a rotating desiccant wheel device or other suitable dehumidifying arrangement. In the cooling mode of operation of the system 1, the desiccant wheel device 66 is generally arranged such that approximately one-half of the desiccant media thereof is exposed to the transient load 34 within the energy transfer unit 32 to absorb moisture contained in the media of the transient load 34. As the desiccant media of the desiccant device 66 becomes saturated with moisture from the media of the transient load 34, the desiccant media is rotated out of the media of the transient load 34 and into the media of the transient load 35 in the energy transfer unit 33. The thermal energy being transferred by the heat pumps circuits 38 and 39 into the media of the transient load 35 heats the desiccant media of the desiccant wheel device 66, thereby removing moisture and drying it to thereby rejuvenate the desiccant media of the desiccant wheel device 66 in preparation for reentry into the media of the transient load 34. The desiccant media 66 is thusly alternately recycled through the transient loads 34 and 35 to repetitively continue the associated dehumidification process as desired.

Incremental Load Capability Modifications

Additional variations in the system 1 may include the provision of one or more non-phase change heat exchangers 46, such as a desuperheater, in either or both of the heat pump circuits 38 and/or 39, as schematically illustrated in FIG. 2 wherein one of the non-phase change heat exchangers 46 is shown integrated into the conduit 25. Additionally or alternatively, one of the non-phase change heat exchangers 46 may be integrated into the conduit 24. As the relatively high temperature, relatively high pressure gaseous refrigerant passes through each of the non-phase change heat exchangers 46, an incremental quantity of the heat energy contained in the refrigerant is transferred into a separate heat transfer media caused to flow through conduits 48 and 49 by a mass transfer device 47, as exemplarily shown in FIG. 2. The incremental quantity of energy so transferred may then be supplied to another independent load as desired. Since only an incremental quantity of the heat energy has been removed from the refrigerant by the non-phase change heat exchangers 46, the refrigerant exits therefrom and continues on into the cycle or respective cycles of the first and second heat pump circuits 38 and/or 39 in a relatively high temperature, relatively high pressure substantially gaseous phase, as hereinbefore described.

It is to be understood that each desuperheater 46 may be operative when the respective heat pump circuit 38 or 39 is operating in a heating mode or a cooling mode, as desired. It is also to be understood that one or more of the desuperheaters 46 may be operative in one or more of the heat pump circuits 38 and 39 as the system 1 is being operated in a heating mode only, a cooling mode only, a dehumidification mode only, or any desired combination of these modes.

Special Applications

Variations in the present invention are provided for applications wherein extreme temperatures and associated loading characteristics of either or both of the transient loads 34 and 35 may be encountered. In the case of the transient loads 34 and/or 35 having extremely low temperatures while operating the system 1 in the heating mode of operation, the heat pump circuits 38 and 39 preferably include respective minimum refrigerant pressure mechanisms, such as hot gas bypass valves 50 and 51 and respective bypass conduit loops 52 and 53, for example. A function of the hot gas bypass valves 50 and 51 is to maintain predetermined minimum refrigerant pressure or pressures in the conduits 30 and 31 during the heating mode of operation of the system 1, such as approximately 45 psi or other suitable pressure. The hot gas bypass valves 50 and 51 may also be modulated by the control mechanism 69 to thereby maintain the overall energy transfer rate to transient loads 34 and 35 at a specific level. In addition, operation of the first and second heat pump circuits 38 and 39 may be facilitated by including respective pressure regulating valves 54 and 55 in the conduits 22 and 23 downstream from the transient heat exchangers 6 and 7. A function of the pressure regulating valves 54 and 55 is to maintain a minimum refrigerant pressure or pressures within the respective transient heat exchangers 6 and 7, such as approximately 45 psi or other suitable pressure, while operating the system 1 in the heating mode.

In the case of the transient loads 34 and/or 35 having extremely low temperatures while operating the system 1 in the cooling mode, the heat pump circuits 38 and 39 preferably include respective refrigerant bypass mechanisms, such as pressure regulators 56 and 57 and respective check valves 58 and 59 appropriately situated in respective bypass conduits 60 and 61, for example. The bypass pressure regulators 56 and 57 are configured to allow liquid refrigerant to respectively bypass the expansion valve 10 from the conduit 19 to the conduit 17, and the expansion valve 11 from the conduit 18 to the conduit 16, to thereby maintain a predetermined minimum liquid refrigerant pressure or pressures at the respective inlets of the transient load heat exchangers 7 and 6, such as approximately 60 psi or other suitable pressure or pressures.

It is to be understood that the heat exchangers 8 and 9 may be replaced with a single combination heat exchanger having independent refrigerant flow passages for each of the heat pump circuits 38 and 39, as schematically illustrated and designated by the numeral 68 in FIG. 2. Such a modification may be particularly applicable when operating the system 1 in extreme cold temperature conditions as icing, under such circumstances, may form in the transient heat exchangers 8 and 9.

In the case of applications wherein the loading characteristics of either or both of the transient loads 34 and 35 may involve extremely high temperatures as the system 1 is operating in the cooling mode, the system 1 may include a condensate dissipation mechanism wherein condensate from the transient heat exchangers 6 and 7 is preferably collected, such as in respective drip pans 40 and 41. The condensate collected by the drip pans 40 and 41 may then be transported through conduits 42 and 44 by a pump 43 to a dissipater 45 which dissipates the condensate in the energy transfer unit 33, such as in association with one or both of the transient heat exchangers 8 or 9 or the combination heat exchanger 68, to thereby improve the heat transfer efficiency and capacity thereof through the principle of evaporation. In configurations where the transient heat exchangers 6 and 7 are physically located above the heat exchangers 8 and 9, it may be desirable to eliminate the pump 43.

For applications in very extreme cold climate conditions, an optional auxiliary heater 67 may be required, as illustrated in FIG. 2. For example, the optional auxiliary heater 67 may comprise a resistance heater, a combustion heater, a waste heat exchanger, or other suitable auxiliary heat generating arrangement. When needed, the auxiliary heater 67 preferably provides a final stage of heat transfer into the transient load 34 during the heating mode of operation of the system 1. The auxiliary heater 67 is preferably controlled by the control mechanism 69.

It is to be understood that the system 1 may be selectively operated in a heating only mode, a cooling only mode, a dehumidifying only mode or any combination of those modes, as desired.

It is also to be understood that while certain forms of the present invention have been illustrated and described herein, it is not to be limited to the specific forms or arrangement of parts described and shown.

What is claimed and desired to be secured by Letters Patent is as follows:

1. A heating, cooling, and dehumidifying system, comprising at least two heat pump circuits, each of which is connected in thermal transfer communication between two different respective media and includes:

a) structure to provide a circuit heating mode wherein thermal energy is transferred from a first one to the second one of the two different respective media; and b) structure to provide a circuit cooling mode wherein thermal energy is transferred from the second one to the first one of the two different respective media; and wherein said system includes:

c) structure to provide a combination heating mode wherein each of one or more of said at least two heat pump circuits is connected in thermal transfer communication with the same media and operated in its respective circuit heating mode relative to said same media;

d) structure to provide a combination cooling mode wherein each of one or more of said at least two heat pump circuits is connected in thermal transfer communication with the same media and operated in its respective circuit cooling mode relative to said same media; and e) structure to provide a dehumidifying mode wherein at least two of said at least two heat pump circuits are connected in thermal transfer communication with the same media, at least one of said at least two heat pump circuits being operable in its respective circuit heating mode and at least another of said at least two heat pump circuits being operable in its respective circuit cooling mode relative to said same media.

2. The system according to claim 1 wherein said dehumidifying mode structure is further structured to remove humidity from at least one of said two different media.

3. The system according to claim 2, further comprising a control mechanism structured to automatically and selectively control each of said heat pump circuits in either of its respective circuit heating and cooling modes.

4. The system according to claim 3, further including an energy recovery mechanism structured to transfer energy to and from each of said two different media.

5. The system according to claim 4, wherein said control mechanism is further structured to also automatically and selectively control said energy recovery mechanism.

6. The system according to claim 3, wherein said control mechanism is further structured to also automatically and selectively control said dehumidifying mode structure.

7. The system according to claim 3, wherein said dehumidifying mode structure includes said control mechanism being further structured to simultaneously operate one of said at least two heat pump circuits in its respective circuit cooling mode and another of said at least two heat pump circuits in its respective circuit heating mode.

8. The system according to claim 3, wherein said dehumidifying mode structure includes said control mechanism being further structured to simultaneously operate one of said at least two heat pump circuits in its respective circuit heating mode and another of said at least two heat pump circuits in its respective circuit cooling mode.

9. The system according to claim 3, further including:

a) at least one of said at least two heat pump circuits having a refrigerant compression device; and b) said control mechanism including at least one refrigerant pressure mechanism structured to control the refrigerant pressure provided by said refrigerant compression device in respective said at least one of said at least two heat pump circuits.

10. The system according to claim 9, wherein said refrigerant pressure mechanism includes a hot gas bypass valve.

11. The system according to claim 3, wherein said control mechanism includes:

a) a first reversing valve for converting one of said at least two heat pump circuits to and from respective said circuit heating mode and respective said circuit cooling mode; and b) a second reversing valve for converting another of said at least two heat pump circuits to and from respective said circuit heating mode and respective said circuit cooling mode.

12. The system according to claim 1, wherein said dehumidifying mode structure includes a condensate dissipation mechanism.

13. The system according to claim 12, wherein said condensate dissipation mechanism includes:

a) a drip pan;

b) a dissipater positioned in at least one of said two different media; and c) a pump and conduit arrangement interconnecting said drip pan and said dissipater.

14. The system according to claim 1, wherein said dehumidifying mode structure includes a dehumidification device structured to absorb moisture from one of said two different media and release that moisture to the other of said two different media.

15. The system according to claim 14, wherein said dehumidification device includes a rotating desiccant wheel device.

16. The system according to claim 1, further including an energy recovery mechanism structured to transfer energy to and from each of said two different media.

17. The system according to claim 16, wherein said energy recovery mechanism includes:

a) a first auxiliary heat exchanger in thermal transfer communication with one of said two different media; and b) a second auxiliary heat exchanger in thermal transfer communication with the other of said two different media; and wherein said first and second auxiliary heat exchangers are interconnected such that thermal energy is automatically transferred from the hotter of said two different media to the cooler of said two different media.

18. The system according to claim 17, wherein said first and second auxiliary heat exchangers comprise conductive heat exchangers.

19. The system according to claim 17, wherein said first and second auxiliary heat exchangers comprise run-around liquid heat exchangers.

20. The system according to claim 17, wherein said first and second auxiliary heat exchangers comprise expanded plate heat exchangers.

21. The system according to claim 17, wherein said first and second auxiliary heat exchangers comprise heat pipe heat exchangers.

22. The system according to claim 1, further including at least one desuperheater connected to at least one of said at least two heat pump circuits.

23. The system according to claim 22, including at least one valve mechanism adapted to selectively bypass said at least one desuperheater.

24. The system according to claim 1, further including at least one of said at least two heat pump circuits having at least one metering mechanism.

25. The system according to claim 24, including at least one refrigerant bypass mechanism adapted to selectively bypass said at least one metering mechanism.

26. The system according to claim 25, wherein each said at least one refrigerant bypass mechanism includes a pressure regulator and a check valve connected in bypass arrangement about said at least one metering mechanism.

27. The system according to claim 1, further including at least one of said at least two heat pump circuits having a pressure regulating valve.

28. The system according to claim 1, wherein said at least two heat pump circuits include independent refrigerant flow passages through a combination heat exchanger in thermal transfer communication with one of said two different media.

29. The system according to claim 1, wherein at least one of said at least two heat pump circuits includes a muffler.

30. The system according to claim 1, further including at least one auxiliary heater spaced within one or both of said two different media.

31. The system according to claim 1, wherein at least one of said at least two heat pump circuits each includes a refrigerant storage device structured to separate and store excess liquid refrigerant therein.

32. The system according to claim 1, wherein, as said system assumes said dehumidifying mode, said at least one of said at least two heat pump circuits being operated in its respective circuit heating mode is structured to transfer thermal energy to said same media at a greater rate than said at least another of said at least two heat pump circuits being operated in its respective circuit cooling mode is structured to transfer thermal energy from said same media such that said same media is being concurrently dehumidified and heated.

33. The system according to claim 1, wherein, as said system assumes said dehumidifying mode, said at least one of said at least two heat pump circuits being operated in its respective circuit heating mode is structured to transfer thermal energy to said same media at a lesser rate than said at least another of said at least two heat pump circuits being operated in its respective circuit cooling mode is structured to transfer thermal energy from said same media such that said same media is being concurrently dehumidified and cooled.

34. The system according to claim 1, wherein, as said system assumes said dehumidifying mode, said at least one of said at least two heat pump circuits being operated in its respective circuit heating mode is structured to transfer thermal energy to said same media at substantially the same rate as said at least another of said at least two heat pump circuits being operated in its respective circuit cooling mode is structured to transfer thermal energy from said same media such that said same media is substantially being only dehumidified.

35. A system for dehumidifying a gaseous media by utilizing a second media, comprising:

a) a first heat pump circuit having:

1) a first transient load heat exchanger connected in thermal transfer communication with the gaseous media, and 2) a second transient load heat exchanger connected in thermal transfer communication with the second media, wherein said first transient load heat exchanger is structured to absorb thermal energy from the gaseous media and transfer thermal energy to said second transient load heat exchanger; and b) a second heat pump circuit having:

1) a third transient load heat exchanger connected in thermal transfer communication with the gaseous media, and 2) a fourth transient load heat exchanger connected in thermal transfer communication with the second media;

wherein said third transient load heat exchanger is structured to absorb thermal energy from the second media and transfer thermal energy to said fourth transient load heat exchanger.

36. The system according to claim 35, further comprising an energy recovery mechanism structured to transfer energy to and from the gaseous media and the second media.

37. The system according to claim 35, including a control mechanism structured to automatically and selectively control said first and second heat pump circuits.

38. A system for conditioning a first media by utilizing a second media, said system comprising:

a) a first heat pump circuit having:

1) a first transient load heat exchanger structured to selectively absorb thermal energy from and discharge thermal energy to the first media, and 2) a second transient load heat exchanger structured to selectively absorb thermal energy from and discharge thermal energy to the second media, wherein said first transient load heat exchanger is structured to absorb thermal energy from the first media and transfer thermal energy to said second transient load heat exchanger as said first heat pump circuit operates in a first circuit cooling mode and said second transient load heat exchanger is structured to absorb thermal energy from the second media and transfer thermal energy to said first transient load heat exchanger as said first heat pump circuit operates in a first circuit heating mode;

b) a second heat pump circuit having:

1) a third transient load heat exchanger structured to selectively absorb thermal energy from and discharge thermal energy to the first media, and 2) a fourth transient load heat exchanger structured to selectively absorb thermal energy from and discharge thermal energy to the second media;

wherein said third transient load heat exchanger is structured to absorb thermal energy from the first media and transfer thermal energy to said fourth transient load heat exchanger as said second heat pump circuit operates in a second circuit cooling mode and said fourth transient load heat exchanger is structured to absorb thermal energy from the second media and transfer thermal energy to said third transient load heat exchanger as said second heat pump circuit operates in a second circuit heating mode;

c) a control mechanism structured to automatically and selectively control said first heat pump circuit in either of said first circuit heating and cooling modes and to selectively operate said second heat pump circuit in either of said second circuit heating and cooling modes; and d) a dehumidifying mechanism structured to remove humidity from at least one of the first and second media, wherein said dehumidifying mechanism includes said control mechanism being structured to simultaneously operate said first heat pump circuit in said first circuit heating mode and said second heat pump circuit in said second circuit cooling mode.

* * * * *